United States Patent [19]

Handler et al.

[11] Patent Number: 4,574,530

[45] Date of Patent: Mar. 11, 1986

[54] DRILL POWERED WET OR DRY ABRASIVE APPARATUS

[75] Inventors: Milton E. Handler, Northbrook; Richard Sylvan, Glenview; Herbert Baisch, Palatine, all of Ill.

[73] Assignee: Hirsh Company, Skokie, Ill.

[21] Appl. No.: 587,823

[22] Filed: Mar. 9, 1984

[51] Int. Cl.[4] ..... B24B 41/00; B24B 27/02

[52] U.S. Cl. ..... 51/166 TS; 51/125.5; 51/267; 51/240 A

[58] Field of Search ..... 51/166 R, 166 TS, 240 R, 51/240 A, 267, 125.5; 76/5 R

[56] References Cited

U.S. PATENT DOCUMENTS

| | | | |
|---|---|---|---|
| 1,535,665 | 4/1925 | Henry | 51/267 |
| 4,173,849 | 11/1979 | Mar | 51/166 TS |
| 4,228,618 | 10/1980 | Jensen | 51/240 A |

FOREIGN PATENT DOCUMENTS

| | | |
|---|---|---|
| 528982 | 11/1940 | United Kingdom . |
| 674424 | 6/1952 | United Kingdom . |
| 909428 | 10/1962 | United Kingdom . |
| 1073132 | 6/1967 | United Kingdom . |
| 1363344 | 8/1974 | United Kingdom . |
| 2011811 | 7/1979 | United Kingdom . |

*Primary Examiner*—Roscoe V. Parker

*Attorney, Agent, or Firm*—Dressler, Goldsmith, Shore, Sutker & Milnamow, Ltd.

[57] ABSTRACT

Apparatus is disclosed for mounting a portable power drill with a rotatable abrasive disk for abrading the surface of a workpiece. The apparatus includes a base, a drill holding assembly, a workpiece support table, and a liquid reservoir with bristles for wetting the surface of the disk. The base includes at least one support column having a lug. The support table includes at least one base engaging wall. The base engaging wall has an arcuate channel for receiving the lug. The base engaging wall defines an opening to the channel for accommodating entry of the lug into the channel.

14 Claims, 14 Drawing Figures

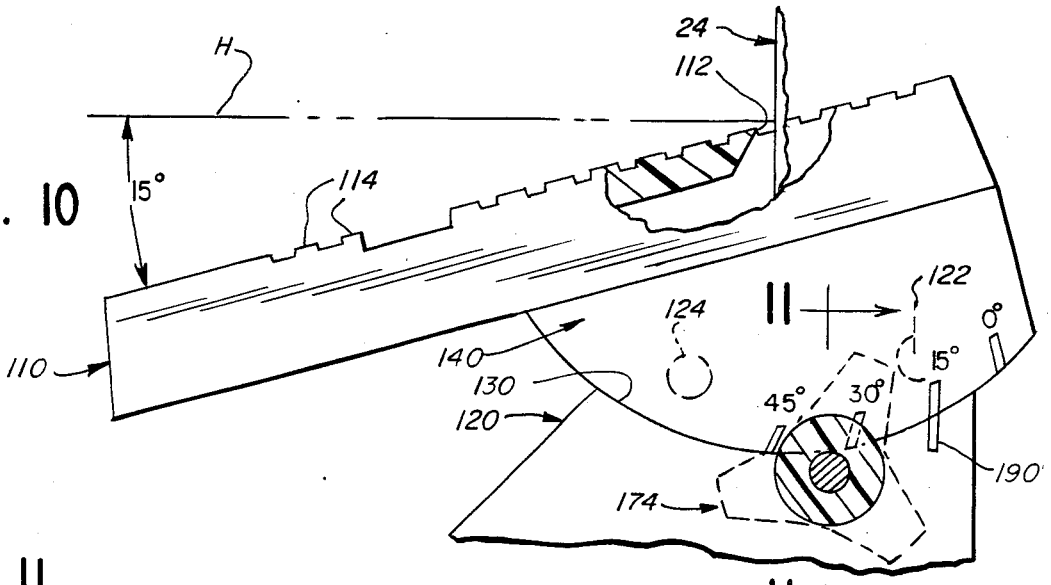
FIG. 10
FIG. 11
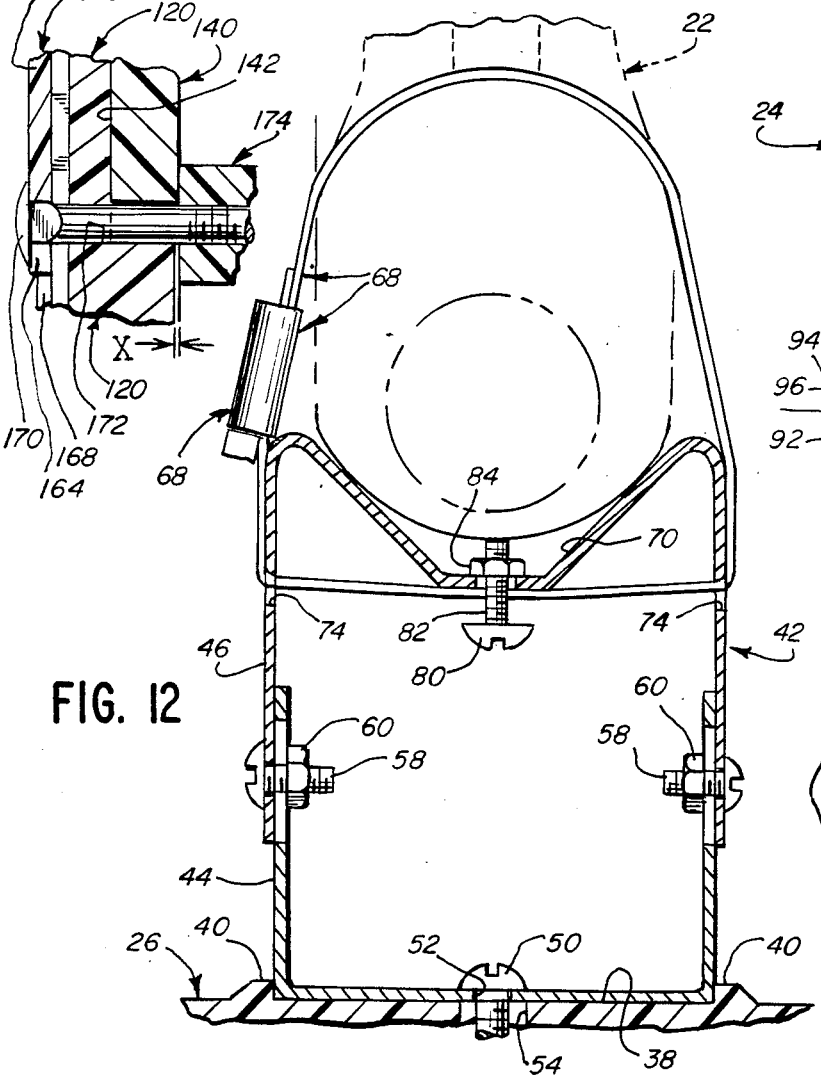
FIG. 12
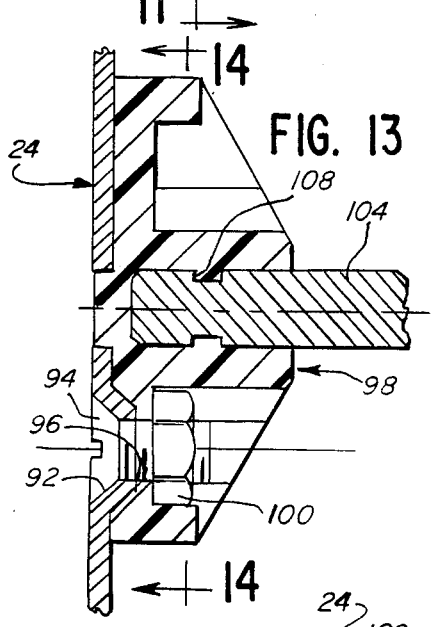
FIG. 13
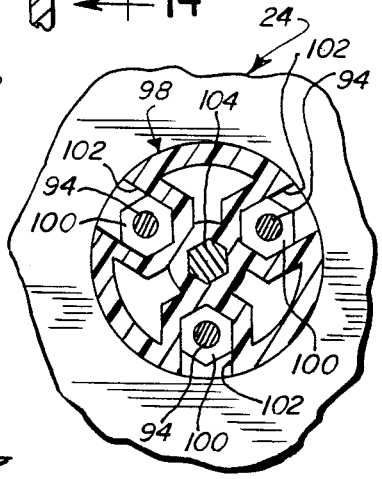
FIG. 14

DRILL POWERED WET OR DRY ABRASIVE APPARATUS

CROSS-REFERENCE TO RELATED APPLICATION

This application is related to apparatus that may be constructed in a variety of aesthetically pleasing designs, including a specific design illustrated in the concurrently filed and commonly assigned U.S. patent application of Milton E. Handler, et al. and entitled, "Support For Drill Powered Abrasive Apparatus And Workpiece.".

TECHNICAL FIELD

This invention relates to apparatus for abrading the surface of a workpiece, such as in wet or dry sanding or grinding.

BACKGROUND OF THE INVENTION

Attachment devices have been developed for use with portable electric power drills to permit the drill to be used to abrade or sand a workpiece. Typically, the drill must be hand held adjacent the workpiece, and the drill must be moved relative to the workpiece to effect the desired abrading or sanding action. With many workpieces, and especially with small workpieces, this method is not very satisfactory. It is difficult to hold a heavy drill at the precise orientation desired. Further, with small workpieces, it can be difficult to view the portion of the workpiece being sanded when using such a method.

Conventional stationary belt sanding machines or grinding wheel machines eliminate many of these problems. However, many conventional stationary machines of this type are larger, more complex, and more costly than a conventional portable electric power drill. The inventors of the present invention believe that there are many more people in the world today who own a portable electric power drill than who own such stationary sanding or grinding machines. Further, it is believed that many such drill owners would like to have the capability for effecting a stationary sanding or grinding operation but do not wish to purchase an expensive stationary sanding or grinding machine.

It has occurred to the inventors of the present invention that it would be desirable to provide an apparatus for cooperating with a conventional portable electric power drill to accommodate sanding or grinding operations at a stationary location where the orientation of the workpiece can be more easily and precisely controlled.

Further, it would be advantageous if such an apparatus could accommodate the support of a workpiece at a plurality of selected orientations relative to the power drill. Additionally, it would be desirable to provide such an apparatus with the capability for permitting the operator to perform wet, as well as dry, sanding operations. Finally, it would be desirable to provide such an apparatus in a form that could be easily fabricated, assembled, disassembled, and stored.

SUMMARY OF THE INVENTION

An apparatus is disclosed for mounting a portable power drill with a rotatable abrasive disk for abrading the surface of a workpiece. One form of the apparatus includes a base and a drill holding means for holding the drill in a position fixed on the base with the abrasive disk oriented to accommodate rotation of the disk at a work station defined adjacent the disk. A workpiece support table is provided for being carried by the base and for supporting the workpiece in contact with the disk at a rear edge of the table.

According to one aspect of the invention, the base includes at least one support column having at least one lug, but preferably both a rear lug and a front lug. The rear lug is located closer to the drill holding means than is the front lug.

The support table includes at least one base engaging wall which defines a channel for receiving the one lug or for receiving two lugs if both the front and rear lugs are provided. The base engaging wall also defines an opening to the channel for receiving the lug or lugs. If front and rear lugs are provided, then the base engaging wall defines a rear opening to the channel for accommodating entry of the rear lug into the channel and defines a front opening to the channel for accommodating entry of the front lug into the channel. The table is mounted to the base with the lug or lugs entering through the one or more openings and being received in the channel in interlocking relation.

In a preferred form of the invention, the angle or orientation of the table relative to the base and disk may be selected. Means are also provided for holding the table at the selected orientation.

Another form of the apparatus also includes a base, a drill holding means, and a workpiece support table. The table may be carried by the base by means of any suitable structure, including, but not limited to, the above-described channel and lug structure. This alternate form of the apparatus is intended for use with wet sanding or grinding. To this end, the apparatus includes a reservoir mounted on the base for holding a liquid, such as water. A plurality of bristles are retained in a brush-like configuration with a lower end adapted to be disposed in the liquid in the reservoir and with an upper end adapted to contact the disk.

Both forms of the apparatus may be conveniently combined into a preferred embodiment of the invention which includes the novel table mounting structure and the novel structures for accommodating the wet sanding operation.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIGS. 6–10 are simplified, partial cross-sectional, fragmentary views of a portion of the apparatus showing the sequence of steps for mounting the workpiece support table to the base at a desired angle of inclination;

FIG. 11 is a fragmentary, cross-sectional view taken generally along the plane 11—11 in FIG. 10;

FIG. 12 is a greatly enlarged, cross-sectional view broken generally along the planes 12—12 in FIG. 4;

FIG. 13 is a greatly enlarged, fragmentary, cross-sectional view of the sanding disk, hub, and connecting shaft; and FIG. 14 is a fragmentary, cross-sectional view taken generally along the plane 14—14 in FIG. 13.

DESCRIPTION OF THE PREFERRED EMBODIMENT

While this invention is susceptible of embodiment in many different forms, this specification and the accompanying drawings disclose only one specific form as an example of the use of the invention. The invention is not intended to be limited to the embodiment so described, and the scope of the invention will be pointed out in the appended claims.

For ease of description, the apparatus of this invention is described in the normal (upright) operating position, and terms such as upper, lower, horizontal, etc., are used with reference to this position. It will be understood, however, that the apparatus of this invention may be manufactured, stored, transported, used, and sold in an orientation other than the position described.

The apparatus of this invention is used with, and includes, certain conventional components the details of which, although not fully illustrated or described, will be apparent to those having skill in the art and an understanding of the necessary functions of such components.

Figure 1:
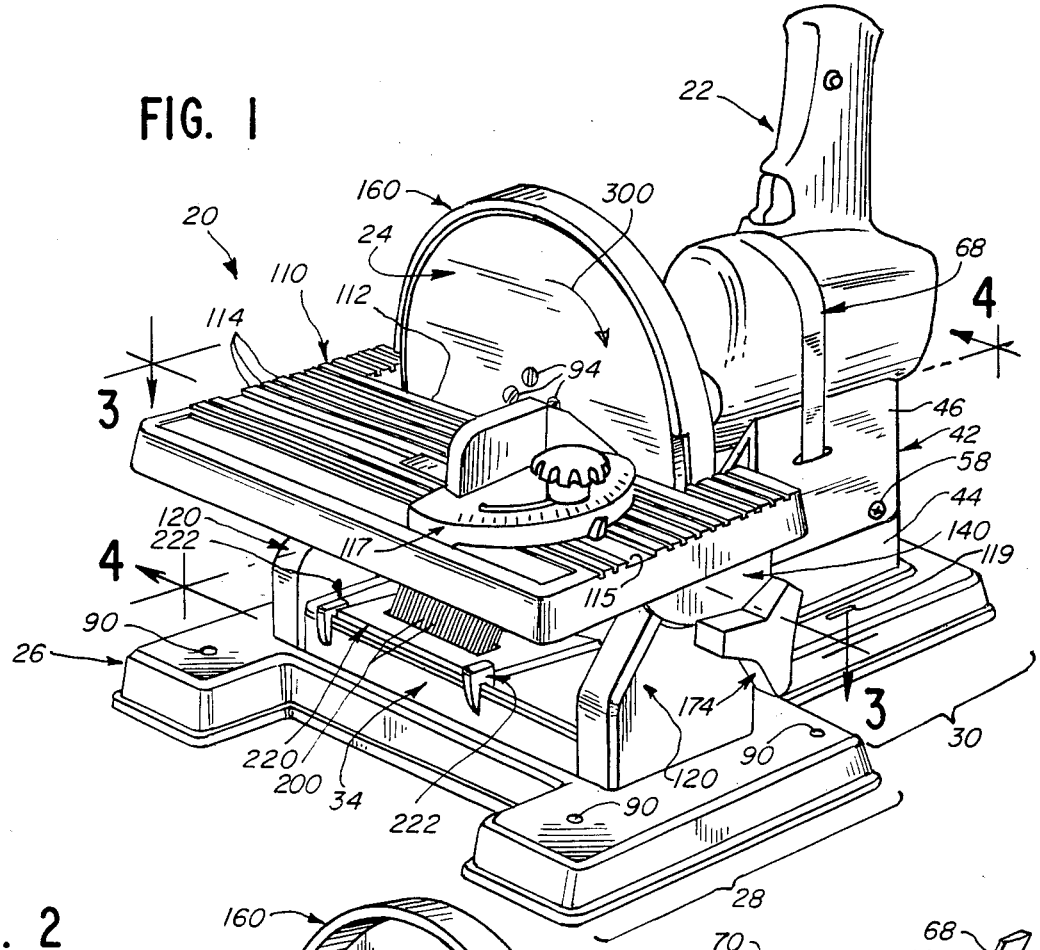
FIG. 1 is a perspective view of the apparatus of the present invention shown with a portable electric drill mounted in the apparatus and operably connected for effecting a wet sanding operation.

With reference to FIG. 1, the apparatus of the present invention is designated generally by the reference numeral 20. The apparatus 20 is adapted for mounting a portable power drill 22 with a rotatable abrasive disk 24 for abrading the surface of a workpiece (not illustrated) at a work station adjacent the disk.

Figure 2:
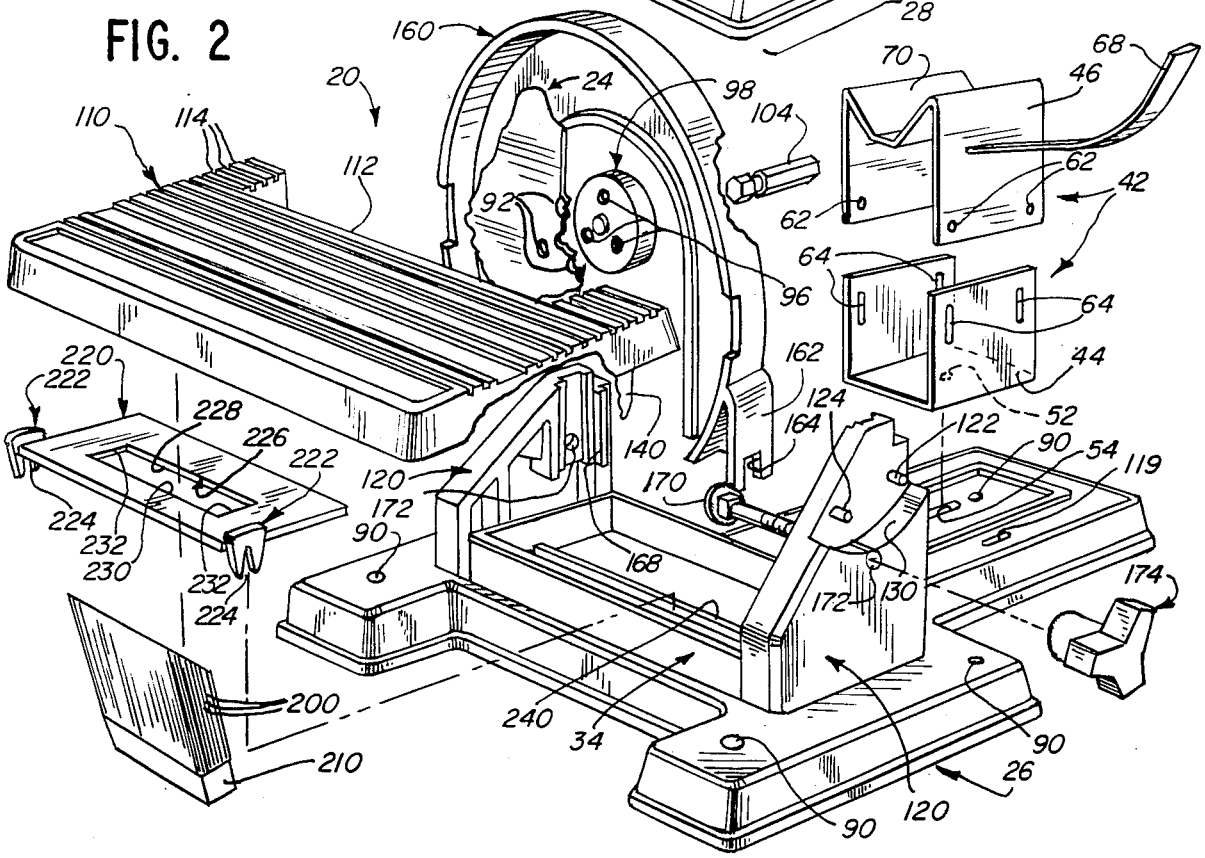
FIG. 2 is a perspective view similar to FIG. 1, but with the components exploded and with some of the components partially broken away to better illustrate underlying detail.
Figure 3:
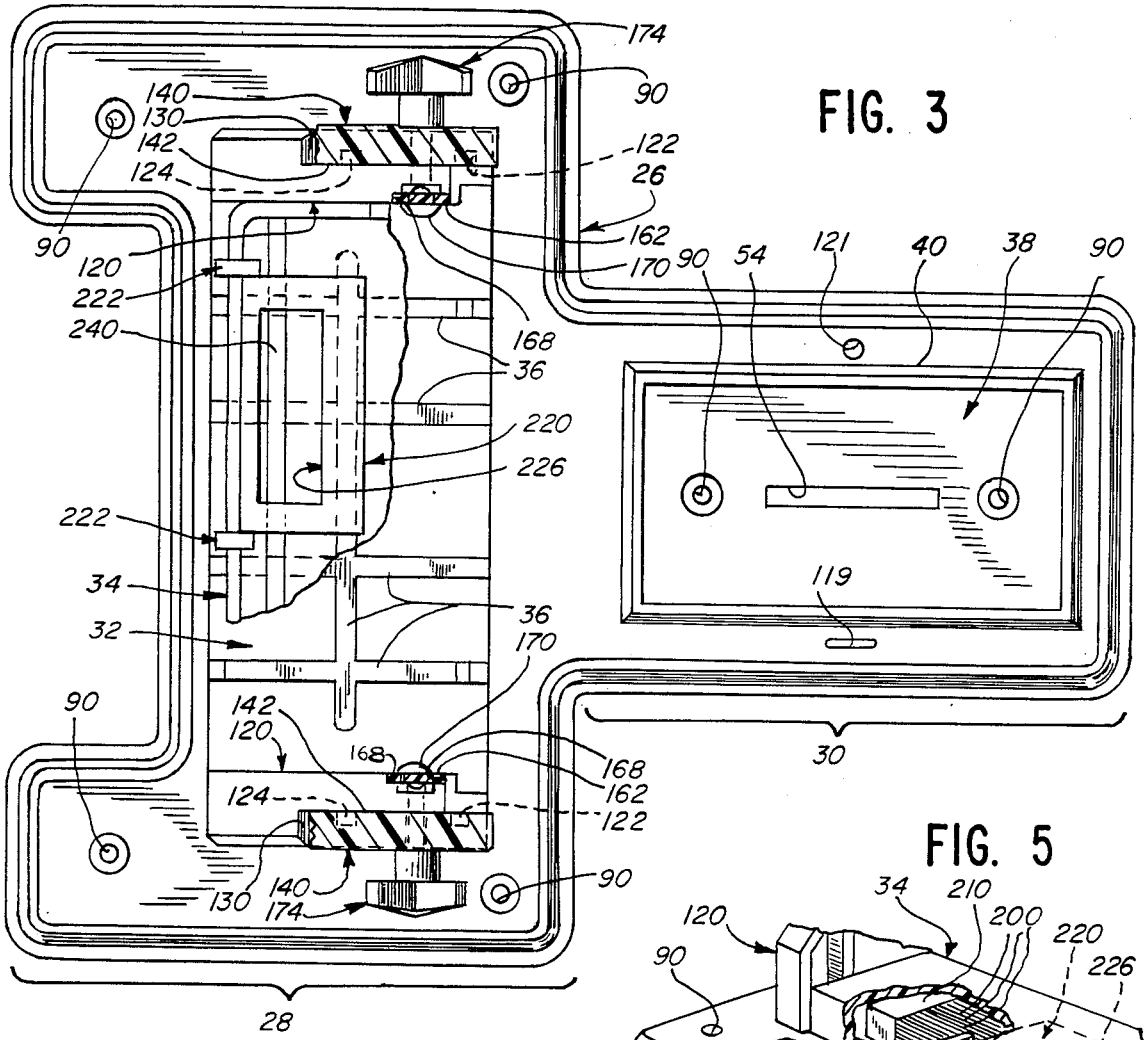
FIG. 3 is a top plan view taken generally along the plane 3—3 in FIG. 1 and more specifically along the planes 3—3 in FIG. 4, but with the drill mounting assembly omitted so as to reveal underlying detail in the apparatus base and with a portion of the liquid reservoir broken away to also reveal underlying detail in the apparatus base.

The apparatus 20 includes a base 26 as best illustrated in perspective view in FIGS. 1 and 2 and in plan view in FIG. 3. The base 26 may be fabricated from any suitable material, including structural foam polypropylene. As best illustrated in FIG. 3, the base includes a front portion 28 and a rear portion 30. The front portion 28 of the base 26 defines a recess 32 (FIG. 3) for receiving a reservoir or tray 34. The bottom of the recess 32 is defined in part by rigidifying struts or ribs 36 on which the tray 34 is supported.

Figure 4:
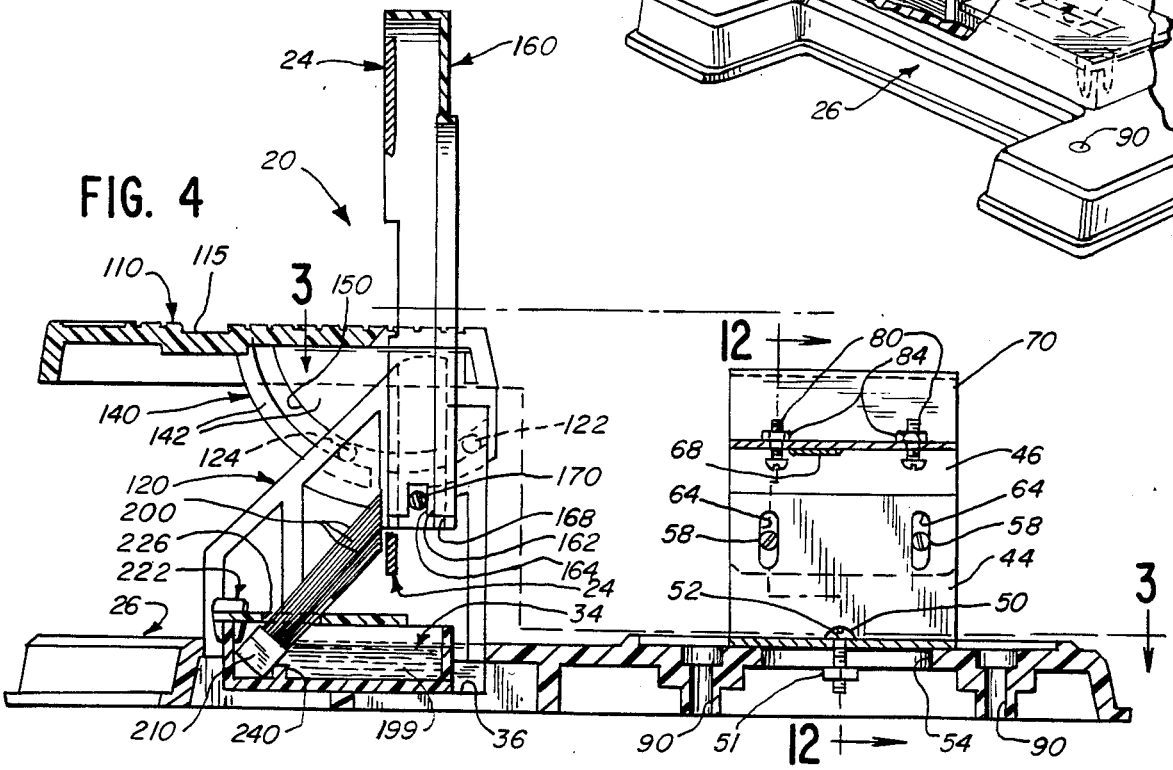
FIG. 4 is a cross-sectional view taken generally along the plane 4—4 in FIG. 1, but again with the drill omitted.

The rear portion 30 of the base 26 defines a mounting region 38 defined by a raised section 40 that defines a rectangular configuration around the region 38. The region 38 is adapted to receive a portable electric drill mounting assembly 42 (FIGS. 1, 2, 4, and 12). The assembly 42 includes a base bracket 44 having a generally U-shaped configuration and an upper bracket 46. The base bracket 44 is mounted to the base 26 with a suitable machine bolt or screw 50 and nut 51 as best illustrated in FIG. 4. The screw 50 is accommodated in a single aperture 52 in the base bracket 44 and in an elongate slot 54 (FIGS. 2, 3, 4, and 12) in the base 26. The elongate slot 54 permits the bracket assembly 42 to be moved rearwardly or forwardly in relation to the base 26 to accommodate portable power drills of various lengths.

The upper bracket 46 is secured to the lower bracket 44 on each side by means of a pair of machine screws 58 and cooperating nuts 60. As best illustrated in FIG. 2, the upper bracket 46 defines an aperture 62 for each screw 58 and the base bracket 44 defines an elongate slot 64 for each screw 58. The elongate slots 64 permit vertical adjustment of the upper bracket 46 relative to the lower bracket 44 to accommodate various portable power drills 22 of different sizes.

The bracket assembly 42 includes a conventional, flexible threaded band clamp 68 as best illustrated in FIGS. 1, 2, and 12. The clamp 68 secures the body of the drill 22, when the drill is inverted, in a cradle region 70 (FIGS. 2, 4, and 12) of the upper bracket 46. The upper bracket 46 includes a slot 74 on each side for receiving the clamp 68 as it passes under the cradle 70 of the upper bracket 46.

Finally, as best illustrated in FIGS. 4 and 12, the bracket assembly 42 includes a pair of adjusting screws 80 which are received in apertures 82 of the cradle 70 of the upper bracket 46. Each screw 80 is maintained with its distal end at a desired elevation relative to the cradle 70 by means of a nut 84. As best illustrated in FIG. 12, the top of the inverted drill body 22 is contacted by the distal ends of the screws 80. Adjustment of the screws 80 provides proper support for maintaining the drill body in a generally horizontal orientation so as to align the rotational axis of the drill 22 generally in a horizontal plane.

In a preferred form, the base 26 includes a plurality of apertures 90 as best illustrated in FIGS. 1–4 for accommodating mounting screws or bolts (not illustrated) which may be used to securely mount the base 26 to a table, work bench, or other suitable frame, if desired.

In a preferred form of the apparatus 20, a sanding disk 24 is provided as a 7″ steel disk with three circular apertures 92 as best illustrated in FIGS. 2 and 13. Each aperture 92 is countersunk for receiving the head of a screw 94 (FIGS. 1, 13, and 14). The threaded end of each screw 94 is received in an aperture 96 (FIG. 13) of a hub 98. The disk 24 is mounted on the hub 98 by means of a nut 100 engaged with each screw 94 and retained within a cavity or trap 102 defined by the wall portions of the hub 98. A hexagonal shaft 104 is received in the central portion of the hub 98 and projects rearwardly out from the hub 98 for being received in the drill chuck (not visible in the figures).

The hub 98 may be injection molded from a suitable material. If desired, the hub 98 may be injection molded with the shaft 104 in place in the mold. In such a construction, the shaft 104 is preferably grooved, as at 108, for receiving the hub molding material and provide an interlocking connection which prevents pull-out during use.

The shaft 104 may be generally cylindrical. However, preferably the exterior surface of the shaft 104 has a polygonal configuration, such as the hexagonal configuration illustrated. This inhibits rotation of the shaft 104 relative to the chuck of the drill 22 as well as relative to the hub 98.

An abrasive surface may be provided on the disk 24 for sanding or grinding operations. The abrasive surface may be integral with the disk. However, in one preferred form, a conventional pressure-sensitive, adhesive-backed, circular sanding disk (not illustrated) may be mounted to the front surface of the disk 24.

The apparatus 20 includes a workpiece support table 110 for being carried by the base 26 and for supporting a workpiece (not illustrated) in contact with the disk 24 at a rear edge 112 of the table 110. The rear edge 112 is defined by a notched portion of the table 110 which is adapted to receive the disk 24. The table 110 thus provides a support surface for the workpiece at the work station which is defined adjacent the disk 24 above the base 26.

The surface of the table 110 may be provided with a plurality of parallel ribs 114 defining grooves for receiving the sanding or grinding particles to prevent build-up on the upper surfaces of the ribs 114.

A novel structure is provided for supporting the table 110 on the base 26. Specifically, the base 26 includes two spaced-apart support columns 120 which each have a rear lug 122 and a front lug 124 (FIGS. 2–4, and 6–10). In the preferred form illustrated, each lug is a cylindrical pin, and the rear lug 122 is located at a greater elevation relative to the base 26 than is the front lug 124. Further, the rear lug 122 is located closer to the drill holding means or bracket assembly 42 than is the front lug 124.

Each support column 120 includes an arcuate receiving surface 130 (FIGS. 2 and 6–10). In the preferred embodiment illustrated, the lugs 122 and 124, along with the arcuate receiving surface 130, accommodate mounting of the workpiece support table 110 as will be explained in detail hereinafter.

The support table 110 includes a pair of spaced-apart base engaging walls 140 (FIGS. 1, 3, and 6–10). One of the base engaging walls 140 depends from each side of the support table 110 and extends below the work support surface of the table 110. As best illustrated in FIGS. 1–4, each base engaging wall 140 is adapted to be located outwardly of, but adjacent, a portion of one of the support columns 120. Further, each base engaging wall 140 preferably includes a vertically disposed bearing surface 142 (FIGS. 3, 4, and 11).

Each engaging wall 140 includes an arcuate channel 150 as best illustrated in FIGS. 4 and 6–9. The channel 150 in each base engaging wall 140 is adapted to receive the front lug 124 and rear lug 122. To this end, each base engaging wall 140 defines a rear opening 152 to the channel 150 for accommodating the entry of the rear lug 122 into the channel 150 and defines a front opening 154 to the channel 150 for accommodating entry of the front lug 124 into the channel 150. The sequential steps by which is table 110 is properly mounted to the base support columns 120 is explained in detail hereinafter. The remaining structure of the table 110, base support columns 120, and associated components are next described in detail.

With reference to FIGS. 1–4 and 11, it can be seen that the apparatus 20 includes a sanding disk guard 160 which is designed to circumscribe at least that portion of the sanding disk 24 that projects upwardly above the support table 110. The disk guard 160 includes a pair of spaced-apart mounting flanges 162 as best illustrated in FIGS. 2–4 and 11. Each flange 162 defines a mounting notch 164 at the bottom of the flange.

Each base support column 120 is adapted to slidably receive one of the sanding disk guard support flanges 162. To this end, as best illustrated in FIGS. 2–4 and 11, each base support column 120 defines a track or channel 168 for slidably receiving one of the sanding disk guard flanges 162.

The sanding disk guard 160, as well as the support table 110, is securely held in position by means of a pair of clamping bolts 170 as best illustrated in FIGS. 2–4 and 11. Preferably, each bolt 170 is a carriage bolt and is received in an aperture 172 in one of the support columns 120. The threaded end of each carriage bolt 170 is threadingly engaged with an internally threaded knob 174 as best illustrated in FIGS. 2, 3, and 11.

The assembly of the carriage bolt 170 and knob 174 on each side of the apparatus 20 is designed to function as a means for clamping together one of the support columns 120 and an adjacent table engaging wall 140 so as to hold the table 110 at a selected orientation relative to the disk 24 and relative to the base 26. Specifically, with reference to FIG. 11, the portion of the table engaging wall 140 above the carriage bolt 170 is adapted to be oriented with the vertically disposed bearing surface 142 bearing against the support column 120. However, the portion of the engaging wall 140 above the carriage bolt 170 projects outwardly a small amount beyond the lower portion of the engaging wall 120—the amount of this projection being designated by an "X" in FIG. 11. Thus, when the knob 174 is turned on the bolt 170 to draw the knob 174 against the engaging wall 140, the knob 174 cannot come into contact with the support column 120. Instead, the knob 174 contacts the engaging wall 140 to clamp together the engaging wall 140, the support column 120, and the sanding disk guard flange 162 between the head of the carriage bolt 170 and the knob 174. Note that the carriage bolt 170 does not rotate in the support column 120 since the square neck portion of the carriage bolt 170 is prevented from rotating in the rectangular notch 164 of the sanding disk guard flange 162.

The sequential steps by which the table 110 is mounted on the base 26 is next described with reference to the FIGS. 6–10. It is to be noted that FIGS. 6–9 are enlarged views of the table and support column region as viewed generally in FIG. 4. It is to be noted that the support column 120 in FIGS. 6–9 is generally in front of, or overlies, the table base engaging wall 140. The portions of the support column 120 which are in the same plane with the base engaging wall 140 are illustrated in section. The remaining portion of the support column 120 that is in front of the table base engaging wall 140 is shown in phantom. On the other hand, FIG. 10 is a side view of the right-hand support column and base engaging wall as viewed in FIG. 1 but with the knob 174 shown partially in section and partially in phantom.

In FIGS. 6–9, the center line location of the sanding disk 24 is indicated by the line designated Z. A fragmentary portion of the disk 24 is shown in FIG. 10.

Figure 6:
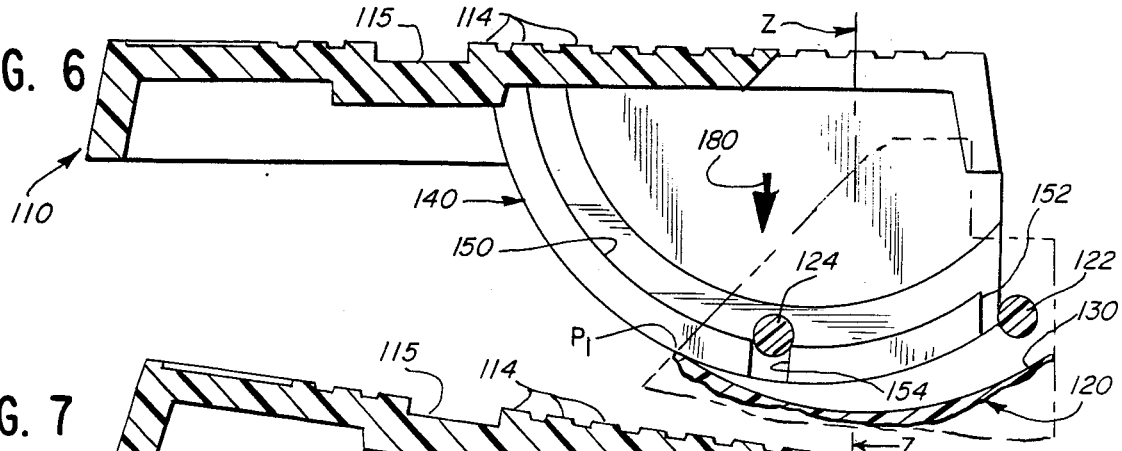

With reference first to FIG. 6, the table 110 is installed by initially orienting it in a generally horizontal position above the support columns 120 to align the openings 154 with the front lugs 124. Then the table 110 is moved generally vertically downwardly in the direction of the arrow 180 until the lower edge of the engaging wall 140 contacts the edge of the support column arcuate receiving surface 130 at the pivot point designated $P_1$.

Figure 7:
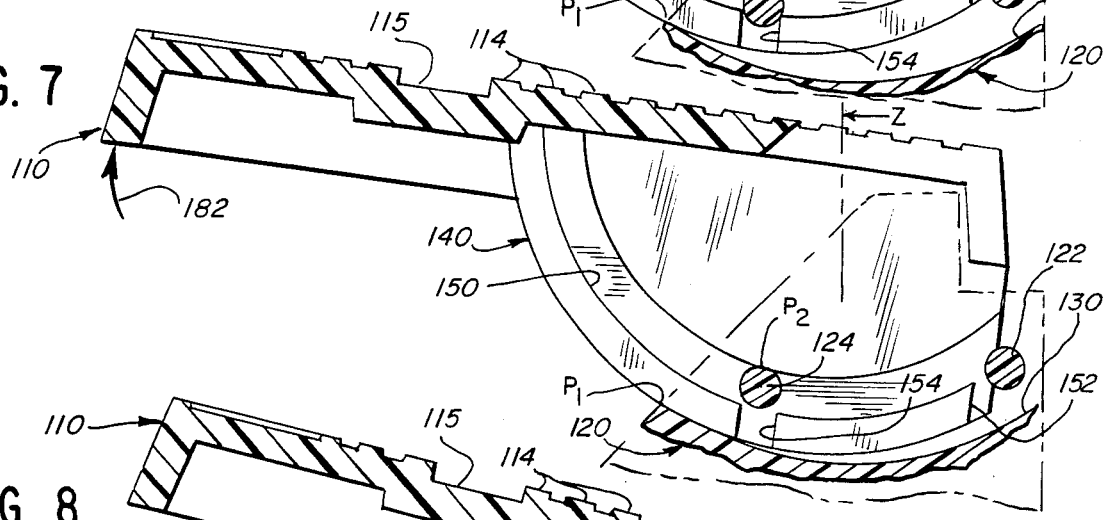

Next, with reference to FIG. 7, the table 110 is tilted upwardly by pivoting it about point $P_1$ in the direction indicated by arrow 182. This pivoting movement is effected until the top of the channel 150 impinges against the top of the front lug 124 at the pivot point designated $P_2$. At this step in the assembly sequence, the rear lug 122 is not yet disposed completely within the arcuate channel 150.

Figure 8:
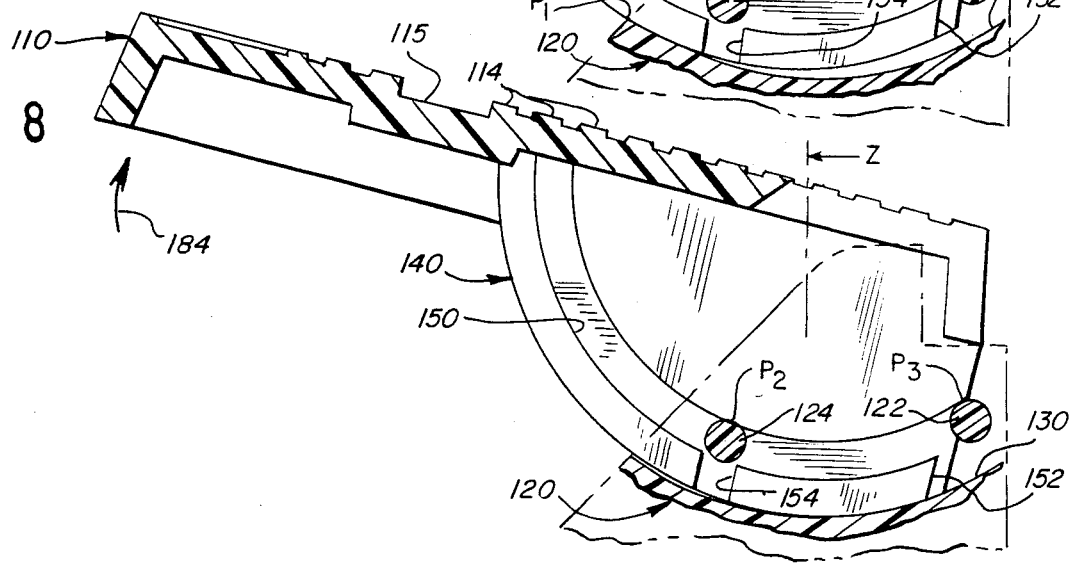

With reference to FIG. 8, the table 110 is next pivoted about point $P_2$ in the direction indicated by arrow 184 until the top of the channel 150 contacts the rear lug 122 at a point designated $P_3$. At this step in the sequence, both the rear lug 122 and the front lug 124 are disposed along the arcuate path defined by the channel 150.

Figure 9:
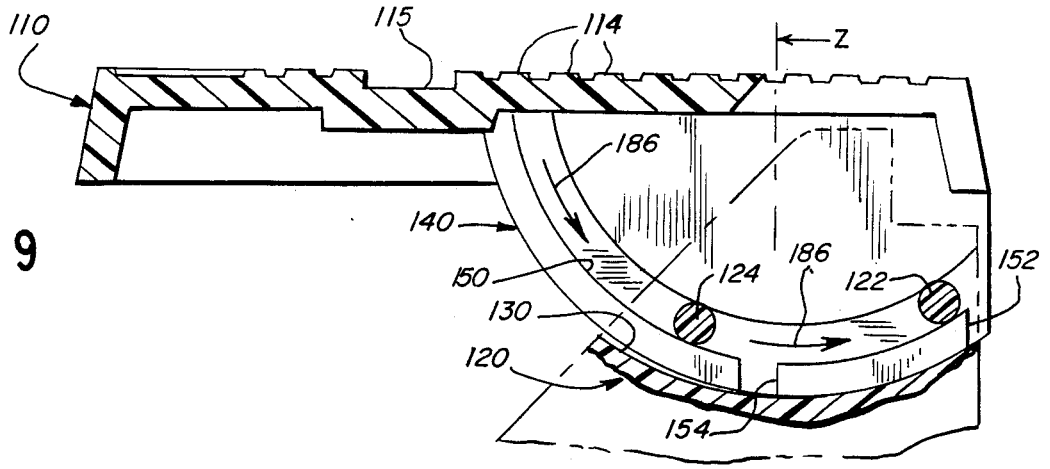

Next, with reference to FIG. 9, the table 110 is moved in an arcuate path designated by the arrows 186. This arcuate path is the path defined by the channel 150. During this step, the table 110 is moved so that the upper surface of the channel 150 stays in sliding contact with the upper surface of both the front lug 124 and the rear lug 120 so that the openings 152 and 154 easily slide past the lugs 122 and 124, respectively.

When the rear opening 152 is disposed rearwardly of the rear lug 122 and when the front opening 154 is disposed rearwardly of the front lug 124 as shown in FIG. 9, the table 110 is properly mounted on the base support column 120 in an interlocking relation with the lugs. This prevents the table 110 from being removed from the base 26 unless the above-described assembly steps are reversed.

The novel interlocking assembly and mounting structure described above permits the table 110 to be oriented at an infinite number of angles, within a range consistent with the design, relative to the base 26 and sanding disk 24. FIG. 10 illustrates the table oriented at a 15° angle relative to a horizontal plane which is designated "H" and which is normal to the face of the sanding disk 24. The table 110 is oriented at this angle by continuing to move the table 110 from the horizontal position illustrated in FIG. 9 further in the direction of the arrows 186 to the position illustrated in FIG. 9.

When the table 110 has been oriented at the desired angle, it may be clamped in position by operation of the knobs 174 (FIGS. 1 and 10). To aid in setting the table 110 at the desired angle, the exterior surface of the base engaging wall 140 may be provided with angle indicia or markings for alignment with a single mark 190 on the exterior of the support column 120.

Although the embodiment of the apparatus 20 illustrated in the figures and described above incorporates a pair of spaced-apart support columns 120 and a pair of mating base engaging walls 140, it is to be realized that, with appropriate modifications, one support column and one base engaging wall of an appropriate thickness and configuration would be sufficient. Alternatively, three or more support columns and associated base engaging walls may be provided.

Another aspect of the present invention permits the apparatus 20 to be used for wet, as well as dry, sanding or grinding operations. The wet sanding capability feature may be practiced with the present invention regardless of the particular structure employed for mounting the workpiece support table 110 to the base 26.

The structural features which permit wet sanding operations are illustrated most clearly in FIGS. 1–5. The liquid holding reservoir or tray 34 is adapted to be removed from the base recess 32 (FIG. 3), filled with water 199 (FIG. 4), and returned to the base recess 32. The apparatus also includes a plurality of bristles 200 retained in a brush-like configuration with a lower end adapted to be disposed in the liquid or water in the tray 34 and with an upper end adapted to contact the disk (FIG. 4). Preferably, as best illustrated in FIG. 2, the bristles 200 are retained at the lower end against a wood block insert (not visible in FIG. 2) in a ferrule 210 which is open at the bottom. Typically, the level of the liquid or water 199 (FIG. 4) is higher than at least one top edge of the ferrule 210. However, satisfactory wetting of the disk 24 can be achieved even if the water level is lower than the top edges of the ferrule 210.

The apparatus 20 further includes a locator plate 220 adapted to be mounted over the reservoir or tray 34. In the preferred embodiment illustrated, the plate 220 includes a pair of mounting flanges 222 which each define a slot 224 for being received on an upstanding wall of the tray 34 as best illustrated in FIGS. 1, 3, and 4.

The locator plate 220 defines an elongate aperture 226 for receiving the bristles 200. As best illustrated in FIG. 2, the aperture 226 is defined along the rear side by the plate edge 228, along the front side by the plate edge 230, and along the opposed ends by edges 232. When the bristles 200 are inserted through the aperture 226, the end edges of the bristles are preferably lightly contacted by the plate end edges 232. However, the bristles 200 are preferably not restrained by the plate front edge 230 or plate rear edge 228. Rather, the bristles 200 are allowed to fall together forwardly until the distal ends of the bristles 200 contact the sanding disk 24 as illustrated in FIG. 4.

In order to retain the lower ends of the bristles 200 in a proper orientation, the tray 34 may be provided with a transverse rib 240 as best illustrated in FIGS. 2, 3, and 4. The bristles 200 may be properly disposed in the tray 34 by positioning the ferrule 210 against the upper front corner of the rib 240 as illustrated in FIG. 4.

With the bristles 200 properly disposed in the filled tray 34, the water or other suitable liquid can be drawn up the bristles 200 by capillary action to wet the sanding disk 24 (or whatever special abrasive surface may be mounted to the sanding disk 24). It has been found that conventional, hollow bristles are effective in transporting the water through capillary action from the tray 34 to the surface of the sanding disk 24.

Specifically, the preferred embodiment of the apparatus uses such a bristle that is commercially designated as a "0.008 inch (0.002 mm.) diameter straight black hollow polyester" bristle. Bristles 200 of this type may be provided in the brush-like configuration as a conventional product assembled in a ferrule. One such product that has been found to work well is commercially available from Felton Brush, Inc., 315 Wilson Street, Manchester, N.H. 03105-0538 U.S.A.

Such a product includes a wood block which is inserted below the bottom ends of the bristles in the ferrule and which is impregnated from the bottom with an epoxy compound. In a preferred embodiment, the ferrule is fabricated from polypropylene, and the ferrule has a width of ⅜" (9.5 mm.), a length of 2.5" (63.5 mm.), a height of ½" (12.7 mm.), and a wall thickness of 1/16" (1.6 mm.). The bristles are trimmed at a 40° angle to an overall height of 3½" (88.9 mm.), and are flagged (split)

½" (12.7 mm.) on the long side of the trim. It has been found that good wetting of the disk 24 is achieved when such a bristle configuration is employed. The 40° trim angle ensures that most of the bristles 200 contact the surface of the sanding disk 24 when the bristles are oriented at an angle of about 40° relative to the disk.

It is to be noted with reference to FIGS. 1–3 that the locator plate 220 is not as long as the tray 34. Indeed, in the preferred embodiment illustrated, the length of the locator plate 220 is a little less than one-half the length of the tray 34. This permits the locator plate 220 to be positioned at one end or the other of the tray 34. This accommodates rotation of the drill 22 in either direction. For example, with the bristles 200 located toward the left-hand side of the apparatus 20 as illustrated in FIG. 1, the drill 22 should be operated to rotate in the direction indicated by arrow 300 on the sanding disc 24. If the drill 22 were operated in the opposite direction of rotation, then the locator plate 220 and bristles 200 would have to be moved to the right-hand side of the tray 34.

Figure 5:
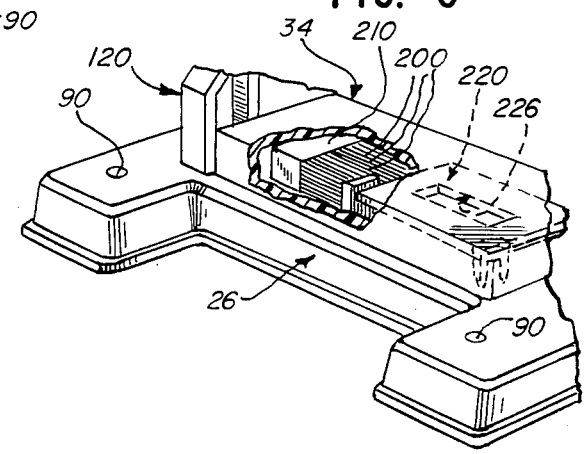
FIG. 5 is a perspective view similar to FIG. 1, but showing only a fragmentary portion of the apparatus with the bristles and bristle support bracket in a storage location below the liquid reservoir which is in an inverted storage position.

The tray 34, locator plate 220, and bristles 200 can be conveniently stored in a self-contained, self-protective, storage configuration when not in use. This is illustrated in FIG. 5. The bristles 200, locator plate 220, and tray 34 are first removed from the base 26 and the liquid, if any, is emptied from the tray 34. Next, the bristles 220 are disposed horizontally in the recess 34 on top of the ribs 36 (the ribs 36 being visible only in FIGS. 3 and 4). The locator plate 220 is then disposed on top of the bristles 200 as illustrated in FIG. 5. Finally, the empty tray 34 is inverted and placed over the bristles 200 and locator plate 220. In this manner, the components are protected from falling particulate matter and dust.

The surface of the table 110 is also preferably provided with one large groove 115 for receiving a conventional miter gauge 117 (FIG. 1). The base 26 may be provided with a slot 119 (FIGS. 1–3) for receiving the miter gauge during storage of the gauge 117 when it is not being used on the table 110.

As best illustrated in FIG. 3, the rear portion 30 of the base 26 may also be provided with an aperture 121 for receiving the drill chuck key for storage when the key is not being used.

It will be readily observed from the foregoing detailed description of the invention, and from the illustrated embodiments thereof, that numerous variations and modifications may be effected without departing from the true spirit and scope of the novel concepts or principles of this invention.

What is claimed is:

1. Apparatus for mounting a portable power drill with a rotatable abrasive disk for abrading the surface of a workpiece, said apparatus comprising:

a base;

drill holding means for holding said drill in a position fixed on said base with said abrasive disk oriented to accommodate rotation of said disk at a work station defined adjacent said disk;

a workpiece support table for being carried by said base and for supporting the workpiece in contact with said disk at a rear edge of said table;

said base including at least one support column having a rear lug and a front lug, said rear lug being located closer to said drill holding means than is said front lug and; and said support table including at least one base engaging wall, said base engaging wall including an arcuate channel for receiving said front and rear lugs, said base engaging wall defining a rear opening to said channel for accommodating entry of said rear lug into said channel and defining a front opening to said channel for accommodating entry of said front lug into said channel whereby said table may be mounted to said base with said lugs entering through said openings and received in said channel in interlocking relation.

2. The apparatus in accordance with claim 1 in which said support column includes an arcuate receiving surface for accommodating said base engaging wall, said receiving surface defining a pivot edge about which said base engaging wall may be pivoted.

3. The apparatus in accordance with claim 1 in which said rear lug is located at a greater elevation relative to said base than is said front lug.

4. The apparatus in accordance with claim 1 in which said channel defines a circular arc.

5. The apparatus in accordance with claim 1 in which each said lug is a cylindrical pin extending outwardly from said support column.

6. The apparatus in accordance with claim 1 further including means for clamping together said engaging wall and said support column to hold said table at a selected orientation relative to said disk.

7. Apparatus for mounting a portable power drill with a rotatable abrasive disk for abrading the surface of a workpiece, said apparatus comprising:

a base;

drill holding means for holding said drill in a position fixed on said base with said abrasive disk oriented above said base to accommodate rotation of said disk at a work station defined above said base;

a workpiece support table for being carried by said base and for supporting the workpiece in contact with said disk at a rear edge of said table;

said base including two spaced-apart support columns each having a rear lug and a front lug, each said rear lug on a support column being located closer to said drill holding means than is said front lug on the same support column;

said support table including a pair of spaced-apart base engaging walls, each said base engaging wall including an arcuate channel for receiving the front and rear lugs of one of said support columns, each said base engaging wall defining a rear opening to said channel for accommodating entry of one of said support column rear lugs into said channel and defining a front opening to said channel for accommodating entry of one of said support column front lugs into said channel whereby said table may be mounted to said base with said lugs entering through said openings and received in said channels in interlocking relation.

8. The apparatus in accordance with claim 7 in which each said base engaging wall includes a vertically disposed bearing surface for bearing against one of said support columns and further including means for clamping together each said engaging wall and one of said support columns by forcing each said engaging wall bearing surface against one of said support columns.

9. The apparatus in accordance with claim 7 in which said table has a workpiece support surface for supporting said workpiece and in which said base engaging walls each extend below said work support surface.

10. Apparatus for mounting a portable power drill with a rotatable abrasive disk for abrading the surface of a workpiece, said apparatus comprising:

a base, said base including at least one support column having at least one lug;

drill holding means for holding said drill in a position fixed on said base with said abrasive disk oriented to accommodate rotation of said disk at a work station defined adjacent said disk;

a workpiece support table for being carried by said base and for supporting the workpiece in contact with said disk at a rear edge of said table; and said support table including at least one base engaging wall, said base engaging wall including a channel for receiving said lug, said base engaging wall defining an opening to said channel for accommodating entry of said lug into said channel whereby said table may be mounted to said base with said lug entering through said opening and received in said channel in interlocking relation.

11. Apparatus for mounting a portable power drill with a rotatable abrasive disk for abrading the surface of a workpiece, said apparatus comprising:

a base;

drill holding means for holding said drill in a position fixed on said base with said abrasive disk oriented to accommodate rotation of said disk;

a workpiece support table for being carried by said base and for supporting the workpiece in contact with said disk at a rear edge of said table;

a reservoir mounted on said base below said table for holding a liquid; and a plurality of individual bristles retained in a brush-like configuration at an angle to the circular abrasive surface of said disk with a lower end of said configuration adapted to be disposed in said liquid in said reservoir and with an upper end adapted to contact the circular abrasive surface of said disk.

12. The apparatus in accordance with claim 11 in which said bristles are retained at said lower end in a ferrule; in which said reservoir includes a rib; and in which said apparatus further includes a locator plate mounted over said reservoir and defining an aperture wherey said bristles can be disposed to extend through said aperture with said ferrule against said rib and said upper end against said disk.

13. The apparatus in accordance with claim 11 in which said locator plate is releasably mounted to a side of said reservoir.

14. The apparatus in accordance with claim 11 further including a disk guard on said apparatus above said reservoir, said disk guard circumscribing at least a portion of said disk above said support table whereby liquid thrown off of said disk when said disk is rotating impinges on said guard and drains off said guard into said reservoir to recirculate said liquid.

* * * * *